US005737484A

United States Patent [19]

Ozawa

[11] Patent Number: 5,737,484

[45] Date of Patent: Apr. 7, 1998

[54] MULTISTAGE LOW BIT-RATE CELP SPEECH CODER WITH SWITCHING CODE BOOKS DEPENDING ON DEGREE OF PITCH PERIODICITY

[75] Inventor: Kazunori Ozawa, Tokyo, Japan

[73] Assignee: NEC Corporation, Tokyo, Japan

[21] Appl. No.: 710,341

[22] Filed: Feb. 29, 1996

Related U.S. Application Data

[63] Continuation of Ser. No. 184,925, Jan. 24, 1994, abandoned.

[30] Foreign Application Priority Data

Jan. 22, 1993 [JP] Japan ..... 5-008737

[51] Int. Cl.[6] ..... G10L 9/14

[52] U.S. Cl. ..... 395/2.28; 395/2.17; 395/2.31; 395/2.32; 395/2.39

[58] Field of Search ..... 395/2.17, 2.23, 395/2.28, 2.31, 2.32, 2.39

[56] References Cited

U.S. PATENT DOCUMENTS 5,271,089 12/1993 Ozawa ..... 395/2.31
5,295,224 3/1994 Nakamura et al. ..... 395/2.32

FOREIGN PATENT DOCUMENTS 4-270398 9/1992 Japan .
4-363000 12/1992 Japan .
5-006199 1/1993 Japan .

OTHER PUBLICATIONS

Sugamura et al., "Speech Data Compression by LSP Speech Analysis–Synthesis Technique", Institute of Electronics and Communication Engineers of Japan Proceedings, J64–A, pp. 599–606 (1981).

Juang et al., "Multiple Stage Vector Quantization for Speech Coding", *IEEE*, Proc. ICASSP, pp. 597–600 (1982).

Schroeder et al., "Code–Excited Linear Prediction (CELP): High–Quality Speech at Very Low Bit Rates", *IEEE*, Proc. ICASSP, pp. 937–940 (1985).

Kleijin et al., "Improved Speech Quality and Efficient Vector Quantization in SELP", *IEEE*, Proc. ICASSP, pp. 155–158 (1988).

Nakamizo "Signal Analysis and System Identification", Corona Publishing Ltd., pp. iv–x, 81–87 (1988).

Kroon et al., "Pitch Predictors with High Temporal Resolution", *IEEE*, Proc. ICASSP, pp. 661–664 (1990).

(List continued on next page.)

*Primary Examiner*—Allen R. MacDonald
*Assistant Examiner*—Talivaldis Ivars Smits
*Attorney, Agent, or Firm*—Foley & Lardner

[57] ABSTRACT

A voice coder system is capable of coding speech at low bit rates with high speech quality. Speech signals are divided into frames and further divided into subframes. A spectral parameter calculator calculates spectral parameters representing a spectral characteristic of the speech signals in at least one subframe. A quantization unit quantizes the spectral parameters of at least one subframe by switching between a plurality of quantization code books to obtain quantized spectral parameters. A mode classifier includes means for calculating a degree of pitch periodicity based on pitch prediction distortions and determines one of a plurality of modes for each frame using the degree of pitch periodicity. A weighting part weights perceptual weights to the speech signals depending on the spectral parameters obtained in the spectral parameter calculator to obtain weighted signals. An adaptive code book obtains a set of pitch parameters representing pitch periods of the speech signals in a predetermined mode by using the determined mode, the spectral parameters, the quantized spectral parameters, and the weighted signals. An excitation quantization unit searches a plurality of stages of excitation code books and gain code books by using the spectral parameters, the quantized spectral parameters, the weighted signals and the pitch parameters to obtain quantized excitation signals of the speech signals and is able to switch between a plurality of excitation code books and a plurality of gain code books based on the mode determined by the mode classifier.

1 Claim, 5 Drawing Sheets

OTHER PUBLICATIONS

Delprat et al., "A 6 kbps Regular Pulse CELP Coder for Mobile Radio Communications", *Advances in Speech Coding,* pp. 179–188 (1990).

Schroeder et al., "Code–Excited Linear Prediction (CELP): High–Quality Speech At Very Low Bit Rates", IEEE, ICASSP 85, vol. 3:937–940 (1985).

Juang et al., "Multiple Stage Vector Quantization For Speech Coding", IEEE, ICASSP 82, vol. 1:597–600, (1982).

IAI et al., "8 kbit/s Speech coder With Pitch Adaptive Vector Quantizer", *IEEE,* ICASSP 86, vol. 3:1697–1700, (1986).

Boite et al., "A Very Simple And Efficient Weighting Filter With Application to a CELP Coding For High Qualtiy Speech at 4800 Bits/s", *Signal Processing,* vol. 27:109–116, (1992).

O'Neill et al., "An Efficient Algorithm For Pitch Prediction Using Fractional Delays", *Signal Processing VI,* vol. 1:319–322, (1992).

Allen Gersho, "Advances in Speech and Audio Compression", Proc. IEEE, vol. 82, pp.900–918, Jun. 1994.

Andreas S. Spanias, "Speech Coding: A Tutorial Review", Proc. IEEE, vol. 82, pp. 1541–1582, Oct. 1994.

Schroeder, M. R. and Atal, B. S.; Code Excited Linear Prediction: High Quality Speech at Low Bit Rates; Aug., 1985.

Kroon, P. and Atal, B.S.; Strategies for Improving Performance of CELP Coders at Low bit Rates; Sep., 1988.

Galand, Menez, and Rosso; Complexity Reduction of CELP Coders; Jul., 1990.

Taniguchi, Amano, and Johnson; Improving the Performance of CELP–Based Speech Coding at Low Bit Rates; Jun., 1991.

Chen, Cox, Lin, Jayant, and Melohner; A Low–Delay CELP Coder for the CCITT 16 kb/s Speech Coding Standard; Jun., 1992.

MULTISTAGE LOW BIT-RATE CELP SPEECH CODER WITH SWITCHING CODE BOOKS DEPENDING ON DEGREE OF PITCH PERIODICITY

This application is a continuation of U.S. patent application Ser. No. 08/184,925, filed Jan. 24, 1994, now abandoned.

BACKGROUND OF THE INVENTION

The present invention relates to a voice coder system for coding speech signals at low bit rates, particularly under 4.8 kb/s with high quality.

Description of the Related Arts

Conventionally, as a coder system for coding speech signals at low bit rates under 4.8 kb/s, a CELP (code excited LPC coding) system has been known, as disclosed in some documents, for example, "Code-Excited Linear Prediction: High Quality Speech At Very Low Bit Rates" by M. Schroeder and B. Atal, Proc. ICASSP, pp. 939–940, 1985 (Document 1), "Improved Speech Quality And Efficient Vector Quantization In SELP" by Kleijin et al., Proc. ICASSP, pp. 155–158, 1988 (Document 2) and the like. In this system, a linear prediction analysis of speech signals is carried out per each frame (for example, 20 ms) on a transmitter side to extract spectral parameters representing spectral characteristics of the speech signals. The frame is further divided into subframes (for example, 5 ms) and parameters such as delay parameters or gain parameters in an adaptive code book are extracted based on past excitation signals per each subframe. Then, by the adaptive code book, a pitch prediction of the speech signals of the subframes is executed and against a residual signal obtained by the pitch prediction, an optimum excitation code vector is selected from a excitation code book (vector quantization code book) composed of predetermined noise signals to calculate an optimum gain. The selection of the optimum excitation code vector is conducted so as to minimize an error power between a signal synthesized from the selected noise signal and the aforementioned residual signal. An index representing the kind of the selected excitation code vector and the optimum gain as well as the parameters extracted from the adaptive code book are transmitted. A description on a receiver side is omitted herein.

In the above-described conventional system disclosed in the Documents 1 and 2, a sufficiently large size (for example, 10 bits) of the excitation code book is required for obtaining good speech quality. Accordingly, vast amounts of calculations are required to perform the search for the excitation code book. Further, the necessary memory capacity is also vast (for example, in case of 10 bits for 40 dimensions, a memory capacity of 40K words) and thus it is difficult to realize a compact hardware. Also, when increasing the frame length and the subframe length in order to reduce the bit rate and increase the dimension number without reducing the bit number of the excitation code book, the calculation amount is quite remarkably increased.

As a method for reducing the size of the code book, for example, as disclosed in "Multiple Stage Vector Quantization For Speech Coding" by B. Juang et al., Proc. ICASSP, pp. 597–600, 1982 (Document 3), a multiple stage vector quantization method wherein the code book is divided into multiple stages to be composed of multiple stages of subcode books and each subcode book is independently searched.

In this method, since the code book is divided into a plurality of stages of the subcode books, the size of the subcode book per one stage is reduced to, for example, B/L bits (B represents the whole bit number and L represents the stage number) and thus the calculation amount required for the search of the code book is reduced to $L\times2^{B/L}$ in comparison with one stage of B bits. Further, the necessary memory capacity for storing the code book is also reduced. However, in this method, each stage of the subcode book must be independently learned and searched, and performance is greatly reduced as compared with one stage of B bits.

SUMMARY OF THE INVENTION

It is therefore an object of the present invention to provide a voice coder system, free from the aforementioned problems of the prior art, which is capable of coding speech signals at low bit rates, particularly under 4.8 kb/s with good speech quality while using a relatively small quantity of calculation and memory capacity.

In accordance with one aspect of the present invention, there is provided a voice coder system, comprising spectral parameter calculator means for dividing input speech signals into frames and further dividing the speech signals into a plurality of subframes according to predetermined timing, and calculating spectral parameters representing spectral feature of the speech signals in at least one subframe; spectral parameter quantization means for quantizing the spectral parameters of at least one subframe preselected by using a plurality of stages of quantization code books to obtain quantized spectral parameters: mode classifier means for classifying the speech signals in the frame into a plurality of modes by calculating predetermined feature amounts of the speech signals; weighting means for weighting perceptual weights to the speech signals depending on the spectral parameters obtained in the spectral parameter calculator means to obtain weighted signals: adaptive code book means for obtaining pitch parameters representing pitches of the speech signals corresponding to the modes depending on the mode classification in the mode classifier means, the spectral parameters obtained in the spectral parameter calculator means, the quantized spectral parameters obtained in the spectral parameter quantization means and the weighted signals; and excitation quantization means for searching a plurality of stages of excitation code books and a gain code book depending on the spectral parameters, the quantized spectral parameters, the weighted signals and the pitch parameters to obtain quantized excitation signals of the speech signals.

In the voice coder system, the mode classifier means can include means for calculating pitch prediction distortions of the subframes from the weighted signals obtained in the weighting means and means for executing the mode classification by using a cumulative value of the pitch prediction distortions throughout the frame.

In the voice coder system, the spectral parameter quantization means can include means for switching the quantization code books depending on the mode classification result in the mode classifier means when the spectral parameters are quantized.

In the voice coder system, the excitation quantization means can include means for switching the excitation code books and the gain code book depending on the mode classification result in the mode classifier means when the excitation signals are quantized.

In the excitation quantization means, at least one stage of the excitation code books includes at least one code book having a predetermined decimation rate.

Next, the function of a voice coder system according to the present invention will now be described.

Input speech signals are divided into frames (for example, 40 ms) in a frame divider part and each frame of the speech signals are further divided into subframes (for example, 8 ms) in a subframe divider part. In a spectral parameter calculator part, a well-known LPC analysis is applied to at least one subframe (for example, the first, third and/or fifth subframes of the 5 subframes) to obtain spectral parameters (LPC parameters). In a spectral parameter quantization part, the LPC parameters corresponding to a predetermined subframe (for example, the fifth subframe) are quantization by using a quantized code book. In this case, as the code book, any of a vector quantization code book, a scalar quantization code book and a vector-scalar quantization code book can be used.

Next, in a mode classifier part, predetermined amounts are calculated from the speech signals of the frame and the obtained values are compared with predetermined threshold values and a degree of pitch periodicity is calculated. Based on the comparison results, the speech signals are classified into a plurality of modes (for example, 4 kinds) for every frame. Then, in a perceptual weighting part, by using the spectral parameters ai (i=1 to P) of the first, third and fifth subframes, perceptual weighting signals are calculated according to formula (1) every subframe. However, for example, the spectral parameters of the second and fourth subframes are calculated by a linear interpolation of the spectral parameters of the first and third subframes and of the third and fifth subframes, respectively.

$$X_w(z) = x(z)\left[\left(1-\sum_{i=1}^{P} a_i z^{-i}\right)/\left(1-\sum_{i=1}^{P} a_i \eta^i z^{-i}\right)\right] \quad (1)$$

wherein x(z) and $X_w(z)$ represent z-transforms of the speech signals and the perceptual weighting signals of the frame, P represents a dimension of the spectral parameters and $\eta$, represents a constant for controlling a perceptual weighting amount, for example, usually selected to approximately 1.0.

Next, in a adaptive code book part, a delay T and a gain $\beta$ as parameters concerning a pitch are calculated against the perceptual weighting signals for every subframe. In this case, the delay corresponds to a pitch period. The aforementioned Document 2 can be referred to for a calculation method of the parameters of the adaptive code book. Also, in order to improve the performance of the adaptive code book against a female speaker in particular, the delay per each subframe can be represented by not an integer value but a decimal value of every sampling time. More specifically, a paper entitled as "Pitch predictors with high temporal resolution" by P. Kroon and B. Atal, Proc. ICASSP, pp. 661–664, 1990 (Document 4) or the like can be referred to. In this manner, for example, by representing the delay amount of each subframe by the integer value. 7 bits are required. However, by representing the delay amount by the fractional value, the necessary bit number increases to approximately 8 bits but female speech can be remarkably improved.

Further, in order to reduce the calculation amount relating to the calculation of the parameters of the adaptive code books, first, against the perceptual weighting signals, a plurality of proposed delays are obtained every subframe in order from maximizing formula (2) by an open loop search.

$$D(T) = P^2(T)/Q(T) \quad (2)$$

But $$P(T) = \sum_{n=0}^{N-1} x_w(n)x_w(n-T) \quad (3)$$

$$Q(T) = \sum_{n=0}^{N-1} x_w(n-T)^2 \quad (4)$$

As described above, at least one kind of the proposed delay is obtained every subframe by the open loop search and thereafter the neighbor of this proposed value is searched every subframe by a closed loop search using drive excitation signals of a past frame to obtain a pitch period (delay) and a gain. (For more specific method, refer to, for example, Japanese Patent Application No. Hei 3-103262 (Document 5) or the like.)

In a vocal section, the delay amount of the adaptive code book is highly correlated between the subframes and by taking a delay amount difference between the subframes and transmitting this difference, a transmission amount required for transmitting the delay of the adaptive code book can be largely reduced in comparison with a method for transmitting the delay amount for every subframe independently. For instance, when the delay amount represented by 8 bits is transmitted in the first subframe and the difference from the delay amount of the just previous subframe is transmitted by 3 bits in the second to fifth subframes every frame, a transmission information amount can be reduced from 40 to 20 bits per each frame in comparison with a case that the delay amount is transmitted by 8 bits in all subframes.

Next, in a excitation quantization part, excitation code books composed of a plurality of stages of vector quantization code books are searched to select a code vector for every stage so that an error power between the above-described weighting signal and a weighted reproduction signal calculated by each code vector in the excitation code books may be minimized. For example, when the excitation code books are composed of two stages of code books, the search of the code vector is carried out according to formula (5) as follows.

$$D = \sum_{n=0}^{N-1} [x_w(n) - \beta v(n-T)\cdot h_w(n) - \gamma_1 c_{1j}(n)\cdot h_w(n) - \gamma_2 c_{2i}(n)\cdot h_w(n)]^2 \quad (5)$$

In this formula, $\beta v(n-T)$ represents the adaptive code vector calculated in the closed loop search of the adaptive code book part and $\beta$ represents the gain of the adaptive code vector. And $C_{1\,j}(n)$ and $C_{2\,i}(n)$ represent the j-th and i-th vectors of the first and second code books, respectively. Also, $h_w(n)$ represents impulse responses indicating characteristics of the weighting filter of formula (6). Also, $\gamma_1$ and $\gamma_2$ represent the optimum gains concerning the first and second code books, respectively.

$$H_w(z) = \left[\left(1-\sum_{i=1}^{P} a_i \eta^i z^{-i}\right)/\left(1-\sum_{i=1}^{P} a_i \gamma^i z^{-i}\right)\right]\left[1/\left(1-\sum_{i=1}^{P} a_i z^{-i}\right)\right] \quad (6)$$

wherein $\eta$ represents a constant for controlling the perceptual weighting signals of formula (1) and $\gamma$ may have a typical value of approximately 0.8.

Next, after the code vector for minimizing formula (5) of the excitation code books is searched, the gain code book is searched so as to minimize formula (7) as follows.

$$D=\sum_{n=0}^{N-1}[x_w(n)-\beta v(n-T)*h_w(n)-\gamma_{1k}c_{ij}(n)*h_w(n)-\gamma_{2k}c_{2k}(n)*h_w(n)]^2 \quad (7)$$

wherein $\gamma_{1k}$, $\gamma_{2k}$ represent k-th gain code vectors of the two-dimensional gain code book.

In order to reduce the calculation amount when searching the optimum code vectors of the excitation code books, a plurality of proposed excitation code vectors (for example, $m_1$ kinds for the first stage and $m_2$ kinds for the second stage) can be selected and then all combinations ($m_1$,33 $m_2$) of the first and second stages of the proposed values can be searched to select a combination of the proposed values minimizing formula (5).

Also, when the gain code book is searched, the gain code book can be searched against all the combinations of the above-described proposed excitation code vectors or a predetermined number of the combinations of the proposed excitation code vectors selected from all the combinations in a small number order of the error power according to formula (7) to obtain the combination of the gain code vector and the excitation code vector for minimizing the error power. In this way, the calculation amount is increased but the performance can be improved.

Next, in the mode classifier part, a cumulative pitch prediction distortion calculated and the degree of pitch periodicity is determined. First, against the proposed periods T selected every subframe by the open loop search in the adaptive code book part, pitch prediction error distortions as pitch prediction distortions are obtained every subframe according to formula (8) as follows.

$$D_1=\sum_{n=0}^{N-1}X_{w1}^2(n)-P_1^2(T)/Q_1(T) \quad (8)$$

wherein 1 represents the subframe number. And according to formula (9), the cumulative prediction error power of the whole frame is obtained and this value is compared with predetermined threshold values to classify the speech signals into a plurality of modes.

$$D=(1/M)\sum_{l=1}^{5}Dl \quad (9)$$

For example, when the modes are classified into 4 kinds, 3 kinds of the threshold values are determined and the value of formula (9) is compared with the 3 kinds of the threshold values to carry out the mode classification. In this case, as the pitch prediction distortions, pitch prediction gains or the like can be used in addition to the above description.

In the spectral parameter quantization part, spectrum quantization code books with respect to training signals are prepared against some modes classified in the mode classifier part in advance and when coding, the spectrum quantization code books are switched by using the mode information. In this manner, a memory capacity for storing the code books is increased by the switching kinds but it becomes equivalent to providing a larger size of code books as the whole sum. As a result, the performance can be improved without increasing the transmission information amount.

In the excitation quantization part, the training signals are classified into the modes in advance and different excitation code books and gain code books are prepared for every predetermined mode in advance. When coding, the excitation code books and the gain code books are switched by using the mode information. In this way, a memory capacity for storing the code books is increased by the switching but it becomes equivalent to providing a larger size of code books as the whole sum. Hence, the performance can be improved without increasing the transmission information amount.

Further, in the excitation quantization part, at least one stage of a plurality of stages of the code books has a regular pulse construction with a decimation rate (for example, decimation rate=2) whose code vector elements are predetermined. Now, assuming that the decimation rate=1, a usual structure is obtained. By such a construction, the memory amount required for storing the excitation code books can be reduced to 1/decimation rate (for example, reduced to ½ in case of decimation rate=2). Also, the calculation amount required for the excitation code book search can be reduced to nearly below 1/decimation rate. Further, by decimating the elements of the excitation code vectors to make pulses, in vowel parts of the speech or the like, in particular, auditorily important pitch pulses can be expressed well and thus the speech quality can be improved.

BRIEF DESCRIPTION OF THE DRAWINGS

The objects, features and advantages of the present invention will become more apparent from the consideration of the following detailed description, taken in conjunction with the accompanying drawings, in which:

FIG. 8 is a block diagram of a third embodiment of a voice coder system according to the present invention;

DESCRIPTION OF THE PREFERRED EMBODIMENTS

Figure 1:
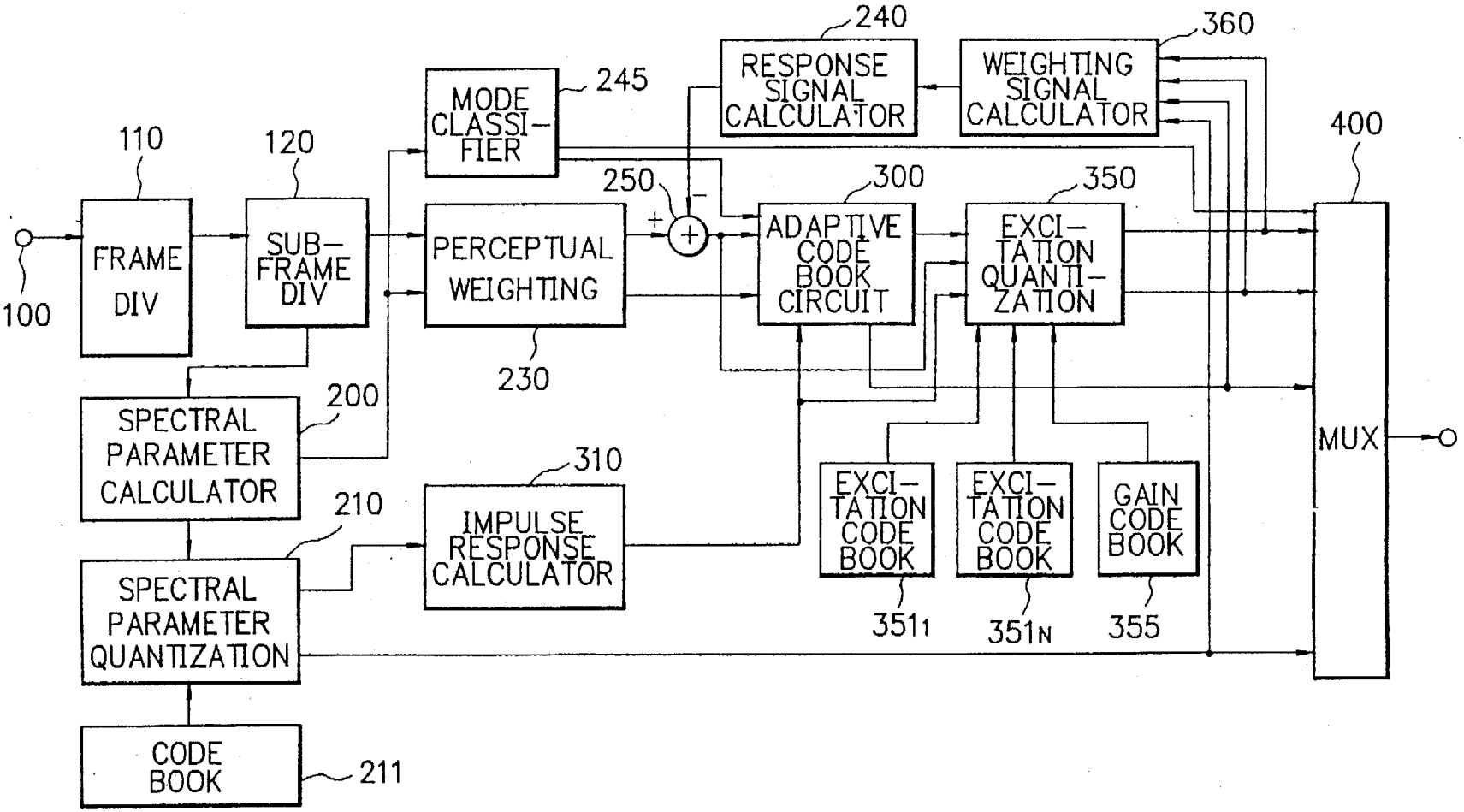
FIG. 1 is a block diagram of a first embodiment of a voice coder system according to the present invention.

Referring now to the drawings, wherein like reference characters designate like or corresponding parts throughout the views and thus the repeated description thereof can be omitted for brevity, there is shown in FIG. 1 the first embodiment of a voice coder system according to the present invention.

As shown in FIG. 1, in the voice coder system, speech signals input from an input terminal 100 are divided into frames (for example, 40 ms per each frame) in a frame divider circuit 110 and are further divided into subframes (for example, 8 ms per each subframe) shorter than the frames in a subframe divider circuit 120.

In a spectral parameter calculator circuit 200, the speech signals of at least one subframe are covered with a long window (for example, 24 ms) longer than the subframe to cut out the speech and the spectral parameters that are calculated at a predetermined dimension (for example, dimension P=10). The spectral parameters largely vary in temporal in a transient interval, particularly, between a consonant and a vowel and hence it is desirable to carry out an analysis for every short time. However, by such an analysis per short time, the calculation amount required for the analysis increases and thus the spectral parameters are calculated against an L (>1) number of some subframes (for example, L=8; the first, third and fifth subframes) within the frame. And in the not-analyzed subframes (such as the second and fourth subframes), the respective spectral parameters for the second and fourth subframes are calculated by a linear interpolation on an LSP described hereinafter by using the spectral parameters of the first and third subframes and of the third and fifth subframes. In this case, for the calculation of the spectral parameters, a well-known LPC analysis, a Burg analysis or the like, can be used. In this embodiment, the Burg analysis is used. The details of the Burg analysis are described, for example, in a book entitled as "Signal analysis and System Identification" by Nakamizo, Corona Publishing Ltd., pp. 82–87, 1988 (Document 6).

Further, in the spectral parameter calculator circuit 200, linear prediction coefficients $\alpha_i$ (i=1 to 10) calculated by the Burg method are transformed into linear spectral pair (LSP) parameters suitable for quantization and interpolation. The conversion of the linear prediction factors to the LSP parameters, for example, is executed by using a method disclosed in a paper entitled as "Speech Information Compression by Linear Spectral Pair (LSP) Speech Analysis Synthesizing System" by Sugamura et al., Institute of Electronics and Communication Engineers of Japan Proceedings, J64-A, pp. 599–606, 1981 (Document 7). That is, the linear prediction factors obtained by the Burg method in the first, third and fifth subframes are transformed into the LSP parameters and the LSP parameters of the second and fourth subframes are calculated by the linear interpolation. The LSP parameters of the second and fourth subframes are restored to the linear prediction coefficients by an inverse transformation and the linear prediction factors $\alpha_{i1}$ (i=1 to 10, 1=i to 5) of the first to fifth subframes are output to a perceptual weighting circuit 230. Also, the LSP parameters of the first to fifth subframes are fed to a spectral parameter quantization circuit 210 having a code book 211.

In the spectral parameter quantization circuit 210, the LSP parameters of the predetermined subframes are effectively quantized. In this embodiment, by using a vector quantization as the quantizing method, the LSP parameters of the fifth subframe are quantized. For the method of the vector quantization of the LSP parameters, well-known methods can be used. (For example, refer to Japanese Patent Application No. Hei 2-297600 (Document 8), Japanese Patent Application No. Hei 3-261925 (Document 9), Japanese Patent Application No. Hei 8-155049 (Document 10) and the like).

Further, in the spectral parameter quantization circuit 210, based on the quantized LSP parameters of the fifth subframe, the LSP parameters of the first to fourth subframes are restored. In this embodiment, by the linear interpolation of the quantized LSP parameters of the fifth subframe in the present frame and the quantized LSP parameters of the fifth subframe in one past frame, the LSP parameters of the first to fourth subframes are restored. That is, after one kind of a code vector for minimizing the LSP parameters before the quantization and the error power of the LSP parameters after the quantization is selected, the LSP parameters of the first to fourth subframes can be restored by the linear interpolation. In order to further improve the performance, after a plurality of proposed code vectors for minimizing the error powers are selected, a cumulative distortion for the proposed code vectors is evaluated according to formula 10 shown below and a set of the proposed code vector for minimizing the cumulative distortion and interpolation LSP parameters can be selected.

$$D=\sum_{l=1}^{5}\sum_{i=1}^{10} c_i b_{il}\,[1sp_{il}-1sp_l']^2 \tag{10}$$

wherein $1sp_{il}$, $1sp'_l$ represent the LSP parameters of the l-th subframe before the quantization and the LSP parameters of the l-th subframe restored after the quantization, respectively, and $b_{il}$ represents the weighting factors obtained by applying formula (11) to the LSP parameters of the l-th subframe before the quantization.

$$b_{il}=(1/[1sp_{i,l}-1sp_{i-1,l}]) \tag{11}$$

Also, $c_i$ is the weighting factors in the degree direction of the LSP parameters and, for instance, can be obtained by using formula (12) as follows.

$$ci=1.0(i=1 \text{ to } 8).\ 0.8(i=9 \text{ to } 10) \tag{12}$$

The LSP parameters of the first to fourth subframes, restored as described above and the quantized LSP parameters of the fifth subframe are transformed into linear prediction factors $\alpha'_{11}$(i=1 to 10, 1=1 to 5) every subframe and the obtained linear prediction factors are output to an impulse response calculator circuit 310. Also, an index representing a code vector of the quantized LSP parameters of the fifth subframe is sent to a multiplexer (MUX) 400.

In the above-described operation, in place of the linear interpolation, a predetermined bit number (for example, 2 bits) of storage patterns of the LSP parameters is prepared and the LSP parameters of the first to fourth subframes are restored with respect to these patterns to evaluate formula (10). A set of the code vector for minimizing formula (10) and the interpolation patterns can be selected. In this manner, the transmission information for the bit number of the storage patterns increases. However, the temporal change of the LSP parameters within the frame can be more precisely expressed. In this case, the storage patterns can be learned and prepared in advance by using the LSP parameter data for training or predetermined patterns can be stored.

In a mode classifier circuit 245, as amounts for carrying out mode classification, prediction error powers of the spectral parameters are calculated are calculated and degree of pitch periodicity is determined. The linear prediction factors for the 5 subframes, calculated in the spectral parameter calculator circuit 200 are input and transformed into K parameters and a cumulative prediction error power E of the 5 subframes is calculated according to formula (13) as follows.

$$E=1/5\sum_{i=1}^{5} G_1 \tag{13}$$

wherein G is represented as follows.

$$G_1=P_1\cdot\left(\prod_{i=1}^{10}[1-k_{i1}^2]\right) \tag{14}$$

In this formula, $P_1$ represents a power of the input signal of the l-th subframe. Next, the cumulative prediction error power E is compared with predetermined threshold values to classify the speech signals into a plurality of kinds of modes. For example, when classifying into four kinds of modes, the cumulative prediction error power is compared with three kinds of threshold values. The mode information obtained by the classification is output to an adaptive code book circuit 300 and the index (in the case of four kinds of modes, 2 bits) representing the mode information is output to the multiplexer 400.

The perceptual weighting circuit 230 inputs the linear prediction factors $\alpha_{i1}$ (i=1 to 10, 1=1 to 5) every subframe from the spectral parameter calculator circuit 200 and executes a perceptual weighting against the speech signals of the subframes according to formula (1) to output perceptual weighting signals.

A response signal calculator circuit 240 inputs the linear prediction factors $\alpha_{i1}$ in each subframe from the spectral parameter calculator circuit 200, also inputs the linear prediction factors $\alpha'_{i1}$ which are quantized and restored by the interpolation, in each subframe from the spectral parameter quantization circuit 210, and calculates response signals $x_2(n)$ for each subframe by using values stored in a filter memory when it is considered that the input signal d(n)=0 to output the calculation result to a subtracter 250. In this case, the response signals $x_2(n)$ are shown by formula (15) as follows.

$$x_2(n) = d(n) - \sum_{i=1}^{10} \alpha_i \eta^i d(n-i) + \sum_{i=1}^{10} \alpha_i \gamma^i y(n-i) + \sum_{i=1}^{10} \alpha_i' x_2(n-1) \quad (15)$$

wherein $\gamma$ represents the same value as that indicated in formula (6).

The subtracter 250 subtracts the response signals of each subframe from the perceptual weighting signals according to formula (16) to obtain $x_{w'}(n)$ which are sent to the adaptive code book circuit 300.

$$X_{w'}(n) = X_w(n) - X_2(n) \quad (6)$$

The impulse response calculator circuit 310 calculates a predetermined point number L of impulse responses $h_w(n)$ of weighting filters, whose z-transform is represented by formula (17) and outputs the calculation result to the adaptive code book circuit 300 and an excitation quantization circuit 350.

$$H_w(z) = \left[\left(1 - \sum_{i=1}^{10} \alpha_i \eta^i z^{-i}\right) / \left(1 - \sum_{i=1}^{10} \alpha_i \gamma^i z^{-1}\right)\right] \cdot \left[1 / \left(1 - \sum_{i=1}^{10} \alpha_i' z^{-i}\right)\right] \quad (17)$$

The adaptive code book circuit 300 inputs the mode information from the mode classifier circuit 245 and obtains pitch parameters only in a case of the predetermined mode. In this case, there are four modes and, assuming that the threshold values at the mode classification increases from mode 0 to mode 3, it is considered that mode 0 and modes 1 to 3 correspond to a consonant part and a vowel part, respectively. Hence, the adaptive code book circuit 300 seeks the pitch parameters only in the case of mode 1 to mode 3. First, in an open loop search, against the output signals of the perceptual weighting circuit 230, a plurality (for example, M kinds) of proposed integer delays for maximizing formula (2) every subframe are selected. Further, in a short delay area (for example, delay of 20 to 80), by using the aforementioned Document 4 or the like against each proposed value, near the integer delays, a plurality kinds of proposed fractional delays are obtained and lastly at least one kind of the proposed fractional delay for maximizing formula (2) is selected every subframe. In the following, for simplifying the description, it is assumed that the proposed number is one kind and one kind of delay selected every subframe is $d_1$ (1=1 to 5). Next, in a closed loop search, based on drive excitation signals v(n) of the past frame, formula (18) is evaluated against predetermined several points $\epsilon$ near $d_1$ every subframe to obtain the delay maximizing its value every subframe and an index $I_d$ representing the delay is output to the multiplexer 400. Also, according to formula (21), adaptive code vectors is calculated to output the calculated adaptive code vectors to the excitation quantization circuit 850.

$$D'(d_1+\epsilon) = P'^2(d_1+\epsilon)/Q(d_1+\epsilon) \quad (18)$$

But $$P'(d_1+\epsilon) = \sum_{n=0}^{N-1} X_w'(n)[v\{n-(d_1+\epsilon)\} \cdot h_w(n)] \quad (19)$$

$$Q(d_1+\epsilon) = \sum_{n=0}^{N-1} [v\{n-(d_1+\epsilon)\} * h_w(n)]^2 \quad (20)$$

wherein $h_w(n)$ is the output of the impulse response calculator circuit 310 and symbol (*) denotes the convolutional operation.

$$q(n) = \beta \cdot V\{n-(d_1+\epsilon)\} \cdot h_w(n) \quad (21)$$

wherein $$\beta = P'(d_1+\epsilon)/Q(d_1+\epsilon) \quad (22)$$

Further, as described above in the function of the present invention, in a vocal section (for example, mode 1 to mode 3), a delay difference between the subframes can be taken and the difference can be transmitted. In such a construction, for instance, 8 bits can be transmitted by the fractional delay of the first subframe in the frame and the delay difference from the previous subframe can be transmitted by 3 bits per each subframe in the second to fifth subframes. Also, at the open loop delay search time, in the second to fifth subframes, an approximate value of the delay of the previous frame is to be searched for 3 bits and the proposed delays are not further selected every subframe but the cumulative error power for 5 subframes is obtained against the path of the 5 subframes of the proposed delays. And the path of the proposed delay for minimizing this cumulative error power is obtained to output the obtained path to the closed loop search. In the closed loop search, the neighbor of the delay value obtained by the closed loop search in the previous subframe is searched for 3 bits to obtain the final delay value and the index corresponding to the obtained delay value every subframe is output to the multiplexer 400.

The excitation quantization circuit 850 inputs the output signal of the subtracter 250, the output signal of the adaptive code book circuit 300 and the output signal of the impulse response calculator circuit 810 and firstly carries out a search of a plurality of stages of vector quantization code books. In FIG. 1, a plurality kinds of the vector quantization code books are shown as excitation code books 351, to 351$_n$. In the following explanation, for simplifying the description, it is assumed that the stages are determined to 2. The search of each stage of code vectors is carried out according to formula (23) obtained by correcting formula (5).

$$D = \sum_{n=0}^{N-1} [x_w'(n) - \beta \cdot q(n) - \gamma_1 c_{1i}(n) \cdot h_w(n) - \gamma_2 c_{2i}(n) \cdot h_w(n)]^2 \quad (23)$$

wherein $X_{w'}(n)$ is the output signal of the subtracter 250. Also, in mode 0, since the adaptive code book is not used. Instead of formula (23), a code vector for minimizing formula (24) is searched.

$$D = \sum_{n=0}^{N-1} [x_w'(n) - \gamma_1 c_{1i}(n) \cdot h_w(n) - \gamma_2 c_{2i}(n) \cdot h_w(n)]^2 \quad (24)$$

There are various methods for searching the first and second stages of code vectors for minimizing formula (23). In this case, a plurality of proposed values are selected from the first and second stages and thereafter a search of a set of both the proposed values is executed to decide a combination of the proposed values for minimizing the distortion of formula (23). Also, the first and second stages of the vector quantization code books are previously designed by using a large amount of speech database in consideration of the aforementioned searching method. The indexes $1_{c1}$ and $1_{c2}$ of the first and second stages of the code vectors determined as described above are output to the multiplexer 400.

Further, the excitation quantization circuit 350 also executes a search of a gain code book 355. In mode 1 to mode 3 using the code books, the gain code book 855 performs a searching by using the determined indexes of the excitation code books $351_1$, to $351_n$ so as to minimize formula (25).

$$D_k = \sum_{n=0}^{N-1} [x_w'(n) - \beta'k \cdot q(n) - \gamma_{1k}'c_{1j}(n) \cdot h_w(n) - \gamma_2'c_{2i}(n) \cdot h_w(n)]^2 \quad (25)$$

In this case, the gains of the adaptive code vectors and the gains of the first and second stages of the excitation code vectors are to be quantized by using the gain code book 355. Now, $(\beta_k, \gamma_{1k}, \gamma_{2k})$ is its k-th code vector. In order to minimize formula (25), for instance, a gain code vector for minimizing formula (25) against the whole gain code vectors (k=0 to $2^B-1$) can be obtained. Alternatively, a plurality kinds of proposed gain code vectors are preliminarily selected and the gain code vector for minimizing formula (25) can be selected from the plurality kinds. After the decision of the gain code vectors, an index $I_g$ representing the selected gain code vector is output. 0n the other hand, in the mode not using the adaptive code book, the gain code book 355 is searched so as to minimize formula (26) as follows. In this case, a two-dimensional gain code book is used.

$$D_k = \sum_{n=0}^{N-1} [x_w'(n) - \gamma_{1k}'c_{1j}(n) \cdot h_w(n) - \gamma_{2k}'c_{2i}(n) \cdot h_w(n)]^2 \quad (26)$$

A weighting signal calculator circuit 360 inputs the parameters output from the spectral parameter calculator circuit 200 and the respective indexes and reads out the code vectors corresponding to the indexes to calculate firstly the drive excitation signals v(n) according to formula (27) as follows.

$$V(n)=\beta'V(n-d)+\gamma'_1C_1(n)+\gamma'_2C_2(n) \quad (27)$$

However, in the mode not using the adaptive code book, it is considered that $\beta'=0$. Next, by using the parameters output from the spectral parameter calculator circuit 200 and the parameters output from the spectral parameter quantization circuit 210, the weighting signals $S_w(n)$ are calculated per each subframe according to formula (28) to output the calculated weighting signals to the response signal calculator circuit 240.

$$Sw(n) = v(n) - \sum_{i=0}^{10} a_1\eta^i v(n-i) + \sum_{i=0}^{10} a_i\gamma^i p(n-i) + \sum_{i=0}^{10} a_i' Sw(n-i) \quad (28)$$

Figure 2:
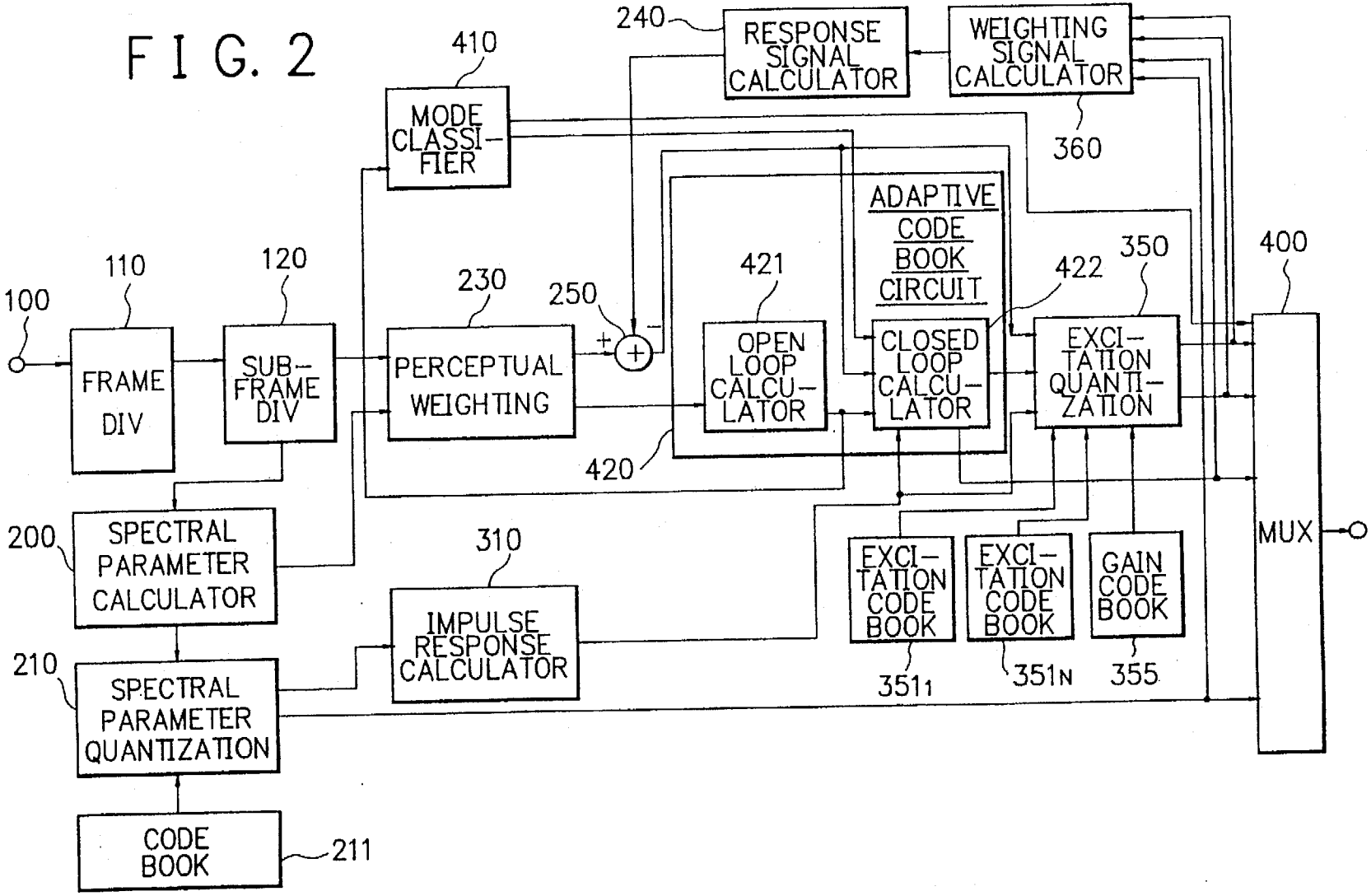
FIG. 2 is a block diagram of a second embodiment of a voice coder system according to the present invention.

FIG. 2 illustrates the second embodiment of a voice coder system according to the present invention.

This embodiment concerns a mode classifier circuit 410. In this embodiment, in place of the adaptive code book circuit 800 of the first embodiment, there is provided an adaptive code book circuit 420 including an open loop calculator circuit 421 and a closed loop calculator circuit 422.

In FIG. 2, the open loop calculator circuit 421 calculates at least one kind of proposed delay every subframe according to formulas (2) and (3) and outputs the obtained proposed delay to the closed loop calculator circuit 422. Further, the open loop calculator circuit 421 calculates the pitch prediction error power of formula (29) every subframe as follows.

$$P_{G1} = \sum_{n=0}^{N-1} x_{w1}^2(n) - P_1^2(T)/Q1(T) \quad (29)$$

The obtained $P_{G1}$ is output to the mode classifier circuit 410.

The closed loop calculator circuit 422 inputs the mode information from the mode classifier circuit 410, at least one kind of the proposed delay of every subframe from the open loop calculator circuit 421 and the perceptual weighting signals from the perceptual weighting circuit 230 and executes the same operation as the closed loop search part of the adaptive code book circuit 300 of the first embodiment.

The mode classifier circuit 410 calculates the cumulative prediction error power $E_G$ as the characterizing amount according to formula (30) and compares this cumulative prediction error power $E_G$ with a plurality of kinds of threshold values and determines a degree of pitch periodicity to classify the speech signals into the modes and the mode information is output.

$$E_G = 1/5 \sum_{i=1}^{N-1} P_{G1} \quad (30)$$

Figure 3:
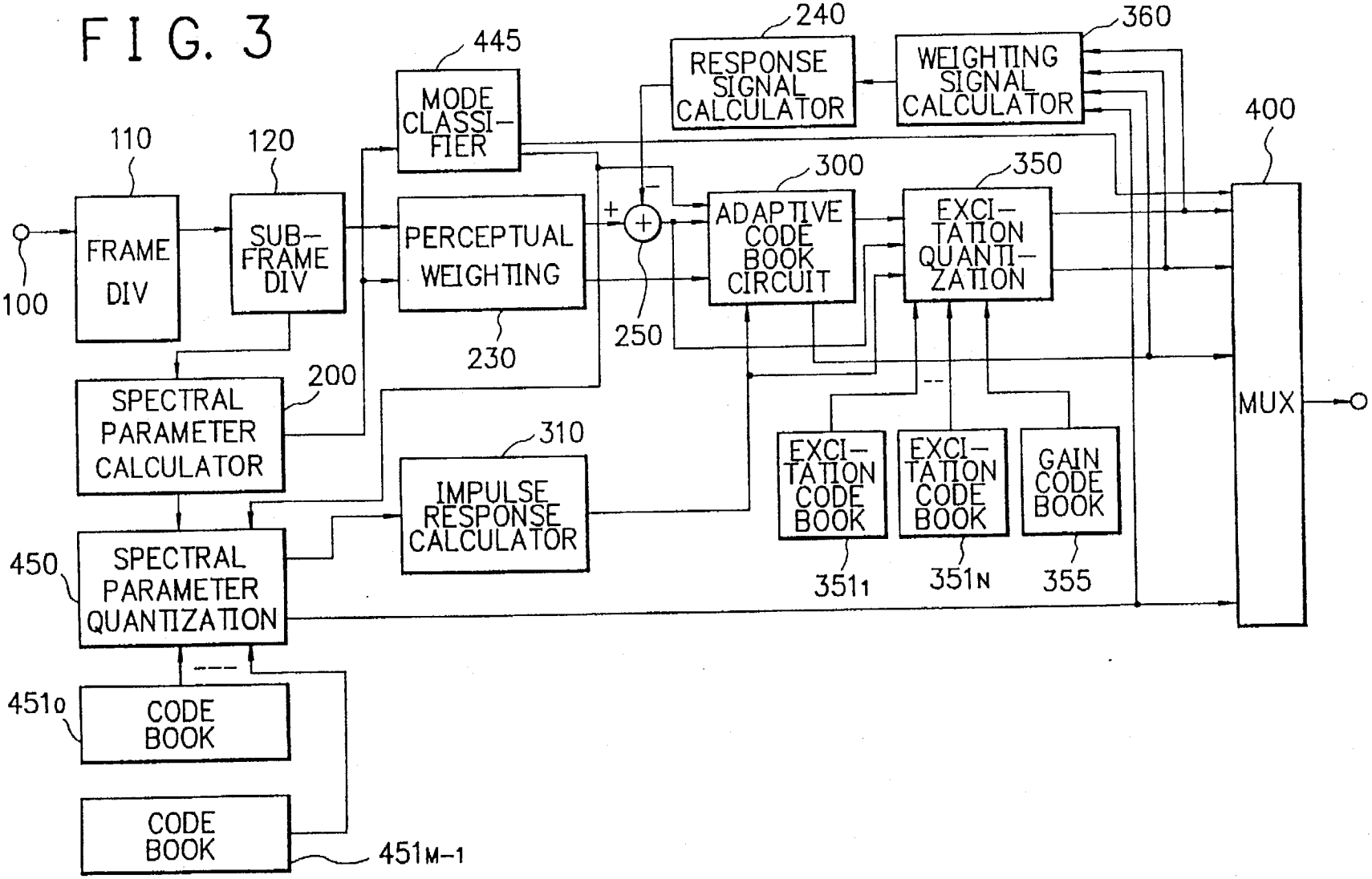

FIG. 3 shows the third embodiment of a voice coder system according to the present invention.

In this embodiment, as shown in FIG. 3, a spectral parameter quantization circuit 450 including a plurality kinds of quantization code books $451_0$ to $451_{M-1}$ for a spectral parameter quantization inputs the mode information from the mode classifier circuit 445 and uses the quantization code books $451_0$ to $451_{M-1}$ by switching the quantization code books in every predetermined mode.

In the quantization code books $451_O$ to $451_{M-1}$, a large amount of spectral parameters for training are classified into the modes in advance and the quantization code books can be designed in every predetermined mode. In this embodiment, with such a construction, while the transmission information amount of the indexes of the quantized spectral parameters and the calculation amount of the code book search can be kept in the same manner as the first embodiment shown in FIG. 1, it is nearly equivalent to becoming several times a code book size and hence the performance of the spectral parameter quantization can be largely improved.

Figure 4:
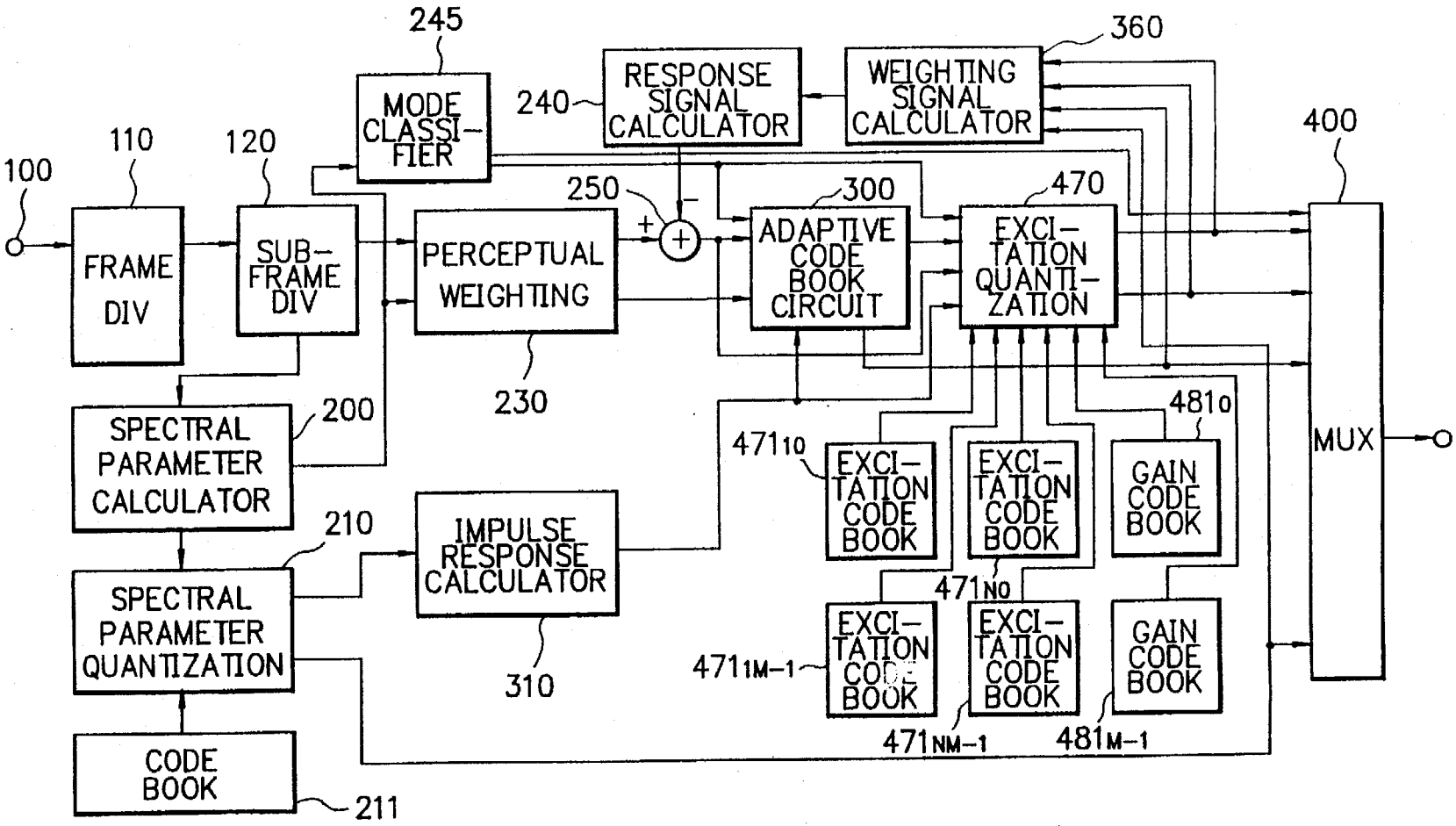
FIG. 4 is a block diagram of a fourth embodiment of a voice coder system according to the present invention.

FIG. 4 illustrates the fourth embodiment of a voice coder system according to the present invention.

In this embodiment, as shown in FIG. 4, a excitation quantization circuit 470 includes M (M>1) sets of N (N>1) stages of excitation code books $471_{10}$ to $471_{1M-1}$, excitation code books $471_{N0}$ to $471_{NM-1}$ (total N×M kinds) and M sets of gain code books $481_0$ to $481_{M-1}$. In the excitation quantization circuit 470, by using the mode information output from the mode classifier circuit 245, in a predetermined mode, the N stages of the excitation code books in a predetermined j-th set within the M sets are selected and the gain code book of the predetermined j-th set is selected to carry out the quantization of the excitation signals.

When the excitation code books and the gain code books are designed, a large amount of speech detabase is classified for every mode in advance and by using the above-described method, the code books can be designed for every predetermined mode. By using these code books, while the excitation code books, the transmission information amount of the indexes of the gain code books and the calculation amount of the excitation code book search can be maintained in the same manner as the first embodiment shown in FIG. 1, and it is nearly equivalent to becoming M times the code book size and hence the performance of the excitation quantization can be largely improved.

Figure 5:
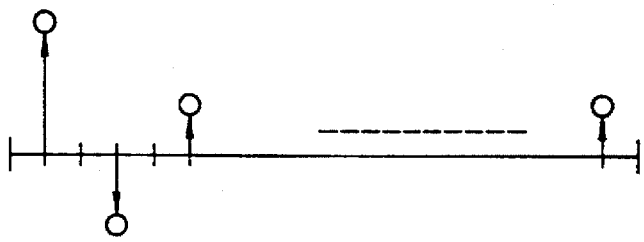
FIG. 5 is a timing chart showing a regular pulse used in the fourth embodiment shown in FIG. 5.

In the excitation quantization circuit 470 shown in FIG. 4, the N stages of the code books are provided and at least one stage of these code books has a regular pulse construction of a predetermined decimation rate, as shown in FIG. 5. In FIG. 5, one example of a decimation rate m=2 is shown. Each division is a 8 khz sampling point of an input speech, and each arrowed circle is an extracted sample at a ½ decimated point for the excitation code book. By using the regular pulse construction, in a position where an amplitude is zero, the calculation processing is unnecessary and thus the calculation amount required for the code book search can be reduced to approximately 1/m. Further, there is no need to store the code books in the position where the amplitude is zero and hence the necessary memory amount for storing the code books can be reduced to approximately 1/m. The detail of the regular pulse construction is disclosed in a paper entitled as "A 6 kbps Regular Pulse CELP Coder for Mobile Radio Communications" by M. Delprat et al., edited by Atal, Kluwer Academic Publishers, pp. 179–188, 1990 (Document 11) or the like and the detailed description can be omitted for brevity.

The code books of the regular pulse construction are also trained in advance in the same manner as the above-described method.

Further, the amplitude pattern of different phases are expressed as the patterns in common to design the code books and at the coding time, by using the code books by shifting only the phase in temporal, in case of m=2, the memory amount and the calculation amount can be further reduced to ½. Moreover, in order to reduce the memory amount, a multi-pulse construction can be used in addition to the regular pulse construction.

According to the present invention, various changes and modifications can be made beside the above-described embodiments.

For example, first, as the spectral parameters, other well-known parameters can be used in addition to the LSP parameters.

Further, in the spectral parameter calculator circuit 200, when the spectral parameters are calculated in at least one subframe within the frame, an RMS change or a power change between the previous subframe and the present subframe is measured and based on the change, the spectral parameters against a plurality of the change, the spectral parameters against a plurality of the large subframes can be calculated. In this manner, at the speech change point, the spectral parameters are necessarily analyzed and hence, even when the subframe number to be analyzed is reduced, the degradation of the performance can be prevented.

For the quantization of the spectral parameters, a well-known method such as a vector quantization, a scalar quantization, a vector-scalar quantization or the like can be used.

As to the selection of the interpolation pattern in the spectral parameter quantization circuit, other well-known distance scale can be used in addition to formula (10). For instance, formula (31) can be used as follows.

$$D = \sum_{l=1}^{5} R_l \sum_{i=0}^{10} c_i b_{il} \, [1sp_{il} - 1sp_l']^2 \tag{31}$$

wherein $$R_l = RMS_l / \left[ \sum_{l=1}^{5} RMS_l \right] \tag{32}$$

In this formula, RMS, is the RMS or the power of the l-th subframe.

Further, in the excitation quantization circuit, the gains $\gamma_1$ and $\gamma_2$ can be equal in formulas (23) to (26). In this case, in the mode using the adaptive code books, the gain code book is of the two-dimensional gain and in the mode not using the adaptive code books, the gain code book is of one dimensional gain. Also, the stage number of the excitation code books, the bit number of the excitation code books of each stage or the bit number of the gain code book can be changed every mode. For example, mode 0 can be of three stages and mode 1 to mode 3 can be of two stages.

Moreover, for example, when the construction of the excitation code books is of two stages, the second stage of the code book is designed corresponding to the first stage of the code book and the code books to be searched in the second stage can be switched depending on the code vector selected in the first stage. In this case, the memory amount is increased but the performance can be further improved.

Also, in the search of the code books and the training of the same, other well-known measures as the distance measure can be used.

Further, concerning the gain code book, the code book having a size several times larger in whole than the transmission bit number is trained in advance and a partial area of this code book is assigned to a use area every predetermined mode. And, when coding, the use area can be used by switching the same depending on the modes.

Furthermore, although a convolutional calculation is carried out at the searches in the adaptive code book circuit and the excitation quantization circuit using formulas (19) to (21) and formulas (23) to (26), respectively, by using the impulse responses $h_w(n)$, this can be performed by a filtering calculation by using the weighting filter whose transfer characteristics can be represented by formula (6). In this way, the calculation amount is increased but the performance can be further improved.

As described above, according to the present invention, the speech is classified into the modes by using the feature amount of the speech, and the quantization methods of the spectral parameters, the operations of the adaptive code books and the excitation quantization methods are switched depending on the modes. As a result, high speech quality can be obtained at lower bit rates as compared with the conventional system.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A voice coder system, comprising:

a spectral parameter calculator for dividing a sequence of input speech signals into a plurality of frames and further dividing the speech signals into a plurality of subframes according to predetermined timing, and calculating spectral parameters representing a predetermined spectral characteristic of the speech signals in at least one of the subframes;

a weighting unit for weighting a set of perceptual weights to the speech signals depending on the spectral parameters calculated by the spectral parameter calculator to obtain a set of weighted signals;

a mode classifier including means for calculating a degree of pitch periodicity based on pitch prediction distortions calculated from the set of weighted signals and for determining one of a plurality of modes for each frame by using the degree of pitch periodicity;

a spectral parameter quantization unit for quantizing the spectral parameters, said spectral parameter quantization unit including means for switching between a plurality of quantization code books, when the spectral parameters are quantized, depending on a mode classification result in the mode classifier;

an adaptive code book for obtaining a set of pitch parameters of the speech signals depending on the mode classification result in the mode classifier using the spectral parameters, the quantized spectral parameters and the set of weighted signals; and an excitation quantization unit for searching a plurality of stages of excitation code books and a plurality of gain code books using the spectral parameters, the quantized spectral parameters and the set of weighted signals to obtain a set of quantized excitation signals of the speech signals, said excitation quantization unit including means for switching between a plurality of excitation code books and a plurality of gain code books depending on the mode determined by the mode classifier.

* * * * *